US007077032B1

(12) United States Patent
Lee

(10) Patent No.: US 7,077,032 B1
(45) Date of Patent: Jul. 18, 2006

(54) RATCHET TOOL HAVING INCREASED DRIVING TORQUE

(76) Inventor: Edmond Lee, 6F-1, No. 67, Sec. 2, Meitsun Road, South Dist., Taichung 40244 (TW)

( * ) Notice: Subject to any disclaimer, the term of this patent is extended or adjusted under 35 U.S.C. 154(b) by 0 days.

(21) Appl. No.: 11/063,418

(22) Filed: Feb. 22, 2005

(51) Int. Cl.
*B25B 13/46* (2006.01)

(52) U.S. Cl. ..... 81/62; 81/63.1

(58) Field of Classification Search ..... 81/58, 81/60, 63.1, 177.85, 62
See application file for complete search history.

(56) References Cited

U.S. PATENT DOCUMENTS

| | | | | | |
|---|---|---|---|---|---|
| 2,982,161 | A * | 5/1961 | Angquist et al. | 81/62 |
| 3,824,881 | A * | 7/1974 | Wright | 81/63 |
| 3,877,556 | A * | 4/1975 | Brownscombe | 192/45.1 |
| 4,399,722 | A * | 8/1983 | Sardo, Jr. | 81/60 |
| 4,436,192 | A * | 3/1984 | Longrod | 192/43.1 |
| 4,466,523 | A * | 8/1984 | De Carolis et al. | 192/43.1 |
| 4,520,697 | A * | 6/1985 | Moetteli | 81/62 |
| 4,762,033 | A * | 8/1988 | Chow | 81/63.2 |
| 5,970,825 | A * | 10/1999 | Barnett et al. | 81/60 |
| 6,044,731 | A | 4/2000 | Hsieh | 81/63.2 |
| 6,076,432 | A * | 6/2000 | Chang | 81/61 |
| 6,138,532 | A | 10/2000 | McCann | 81/63 |
| 6,142,277 | A * | 11/2000 | Barnett et al. | 192/43.1 |
| 6,205,891 | B1 | 3/2001 | Huang et al. | 81/63.1 |
| 6,311,584 | B1 | 11/2001 | Chu | 81/57.29 |
| 6,357,323 | B1 * | 3/2002 | Chi et al. | 81/60 |
| 6,367,354 | B1 * | 4/2002 | Mitchell | 81/59.1 |
| 2001/0003933 | A1 * | 6/2001 | Chi et al. | 81/60 |

* cited by examiner

*Primary Examiner*—David B. Thomas
(74) *Attorney, Agent, or Firm*—Charles E. Baxley

(57) ABSTRACT

A ratchet tool includes a handle having a number of inner teeth, a cartridge rotatably received in the handle and having a driving shank and having three side surfaces. Three pawls are rotatably attached to the side surfaces of the cartridge and each includes two end portions each having one or more teeth for engaging with the teeth of the handle, in order to control the driving direction of the cartridge relative to the handle. A control member includes three spring-biased projections for engaging with the pawls and for forcing the teeth of either of the end portions of the pawls to engage with the teeth of the handle, and to control the driving direction of the cartridge relative to the handle.

10 Claims, 5 Drawing Sheets

RATCHET TOOL HAVING INCREASED DRIVING TORQUE

BACKGROUND OF THE INVENTION

1. Field of the Invention

The present invention relates to a ratchet tool, and more particularly to a ratchet tool including an improved structure having an increased driving torque.

2. Description of the Prior Art

Various kinds of typical ratchet tools have been developed and comprise a cartridge rotatably received in a head of a handle, and a pawl for engaging with the cartridge, in order to control and to determine the driving directions of the typical ratchet tools. Normally, the typical ratchet tools include a single pawl for engaging with the cartridge, such that the driving torque is limited and may not be increased.

For example, U.S. Pat. No. 6,044,731 to Hsieh discloses one of the typical ratchet tools including a pawl rotatably received in the head of the handle, and the pawl includes two end teeth for engaging with outer peripheral teeth provided on the cartridge, so as to control and to determine the driving directions of the typical ratchet tools.

Similarly, U.S. Pat. No. 6,138,532 to McCann discloses another typical ratchet tool including a number of inner peripheral teeth provided in the head of the handle, and a pawl rotatably received in the cartridge and having two end teeth for engaging with the inner peripheral teeth of the head of the handle, in order to control and to determine the driving directions of the typical ratchet tools.

However, the typical ratchet tools include a single pawl for engaging with outer peripheral teeth provided on the cartridge, or for engaging with the inner peripheral teeth of the head of the handle, and may thus have only one point contact between the pawl and the cartridge and the head, such that the driving torque of the typical ratchet tools is limited and may not be increased.

U.S. Pat. No. 6,205,891 to Huang et al., and U.S. Pat. No. 6,311,584 to Chu disclose two further typical ratchet tools each including a number of inner peripheral teeth provided in the head of the handle, and two pawls rotatably received in the cartridge and each having two end teeth for engaging with the inner peripheral teeth of the head of the handle, in order to control and to determine the driving directions of the typical ratchet tools.

The typical ratchet tools include two pawls for engaging with the inner peripheral teeth of the head of the handle. However, there will be only two point contacts provided between the pawl and the cartridge and the head, such that the driving torque of the typical ratchet tools is limited, and the driving connection between the cartridge and the head may not be stable. Normally, three point contacts may form a plan and may provide a stable driving connection between the cartridge and the head.

The present invention has arisen to mitigate and/or obviate the afore-described disadvantages of the conventional ratchet tools.

SUMMARY OF THE INVENTION

The primary objective of the present invention is to provide a ratchet tool including an improved structure having an increased driving torque.

In accordance with one aspect of the invention, there is provided a ratchet tool comprising a handle including a compartment formed therein and defined by an inner peripheral surface, and including a plurality of teeth provided on the inner peripheral surface thereof, a cartridge rotatably received in the compartment of the handle, and including a driving shank extended out of the handle, for engaging with fasteners or tool members, the cartridge including three side surfaces, three pawls rotatably attached to the side surfaces of the cartridge respectively, and each including two end portions each having at least one tooth provided thereon, for selectively engaging with the teeth of the handle, in order to control and to determine a driving direction of the cartridge relative to the handle, and a control member rotatably disposed relative to the cartridge, and including three spring-biased projections disposed therein, for engaging with the pawls respectively, in order to control and to force the tooth of either of the end portions of the pawls to engage with the teeth of the handle, and to control the driving direction of the cartridge relative to the handle, the teeth of the three pawls may be stably engaged with the teeth of the handle. The teeth of the three pawls may have three point contacts between the cartridge and the handle, to allow the cartridge to be solidly engaged with the handle, and to have a greatly increased driving torque between the cartridge and the handle.

The cartridge includes a peripheral panel radially extended therefrom, for rotatably engaging with the handle, and for stably and rotatably attaching the cartridge to the handle. The handle includes a peripheral shoulder formed therein, and provided around the compartment thereof, for rotatably receiving the peripheral panel of the cartridge.

The cartridge includes a cavity formed in each of the three side surfaces thereof, and the pawls each includes a shaft extended therefrom, and rotatably engaged in the cavities of the cartridge respectively, to rotatably attach and secure the pawls to the side surfaces of the cartridge respectively. The cavities of the cartridge each preferably includes a cross section greater than one half but less then three quarters of a circle.

The control member includes three apertures formed therein, and equally spaced away from each other, and arranged corresponding to the pawls respectively, to slidably receive the spring-biased projections respectively.

The control member includes an orifice formed therein, and the cartridge includes a bore formed therein and also formed in the driving shank and includes an orifice laterally formed in the driving shank and communicating with the bore thereof, a ball received in the orifice of the driving shank and engageable into the bore of the cartridge, and a stem slidably received in the bore of the cartridge and having a recess formed therein for receiving the ball therein, and a spring biasing device for biasing the stem relative to the cartridge, to disengage the recess of the stem from the ball, and to force the stem to force the ball out of the driving shank, and the ball is receivable in the recess of the stem when the recess of the stem is aligned with the ball, and when the stem is depressed against the biasing device.

The control member includes a peripheral rib radially extended into the orifice thereof, and the stem includes a peripheral bulge radially extended therefrom, for rotatably engaging with the peripheral rib of the control member, and for stably and rotatably attaching the stem to the control member, and for limiting the stem to slide relative to the control member and the cartridge, and for preventing the stem from being disengaged from the control member and the cartridge.

A cover may further be provided and secured to the cartridge, for stably and rotatably attaching the cartridge to the handle. The cover includes a chamber formed therein for rotatably receiving the control member therein, and includes a peripheral flange radially extended into the chamber thereof, for engaging with and for limiting the control member relative to the cover, and for preventing the control member from being disengaged from the cover and the cartridge, the control member includes a knob extended therefrom, and rotatably engaged out through the chamber and the peripheral flange of the cover, for being rotated by users.

The cartridge includes a retaining ring attached thereto, for rotatably engaging with the handle, and for stably and rotatably attaching the cartridge to the handle. The handle includes a peripheral shoulder formed therein, and provided around the compartment thereof, for rotatably receiving the retaining ring.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
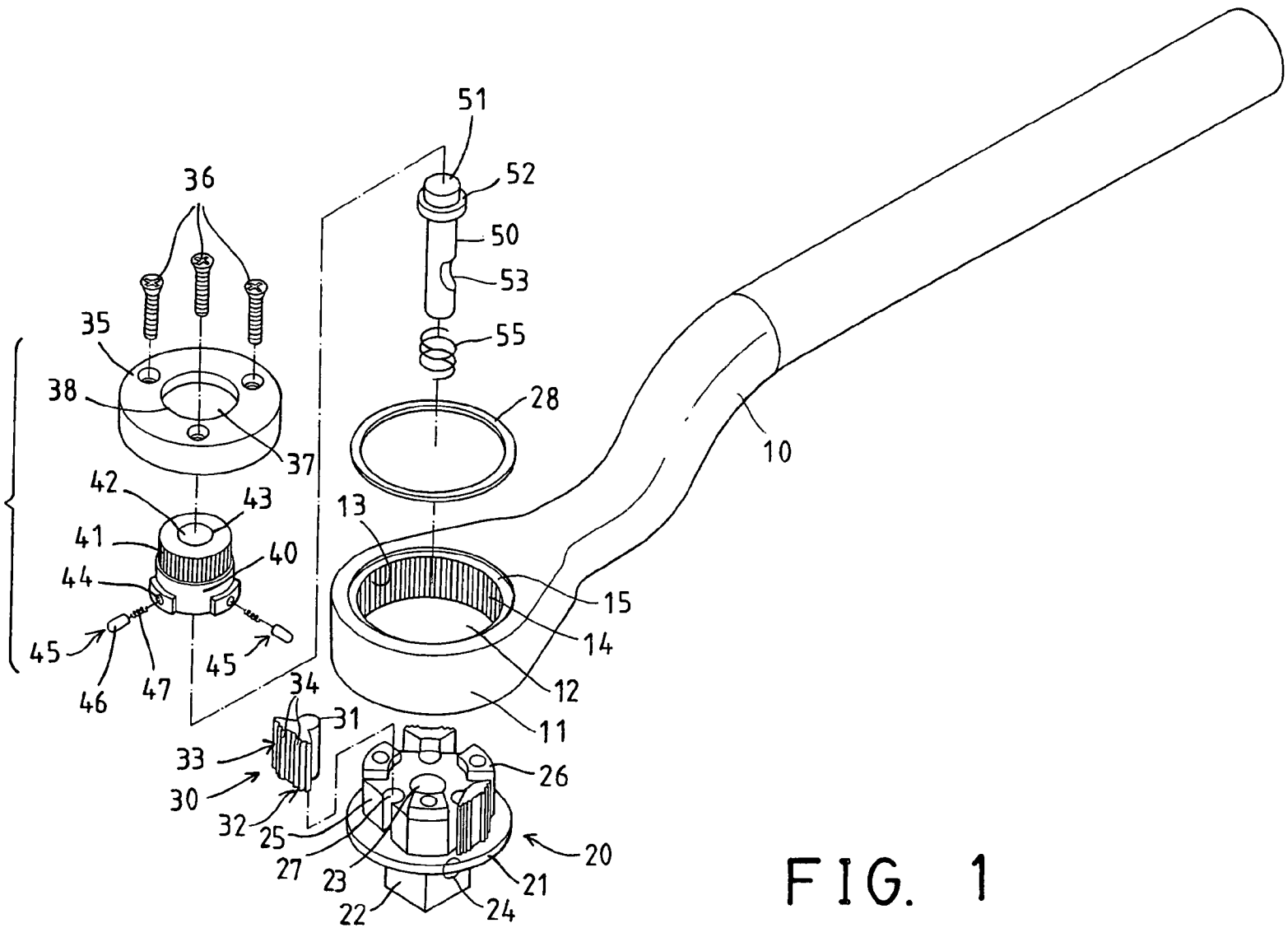
FIG. 1 is an exploded view of a ratchet tool in accordance with the present invention.
Figure 2:
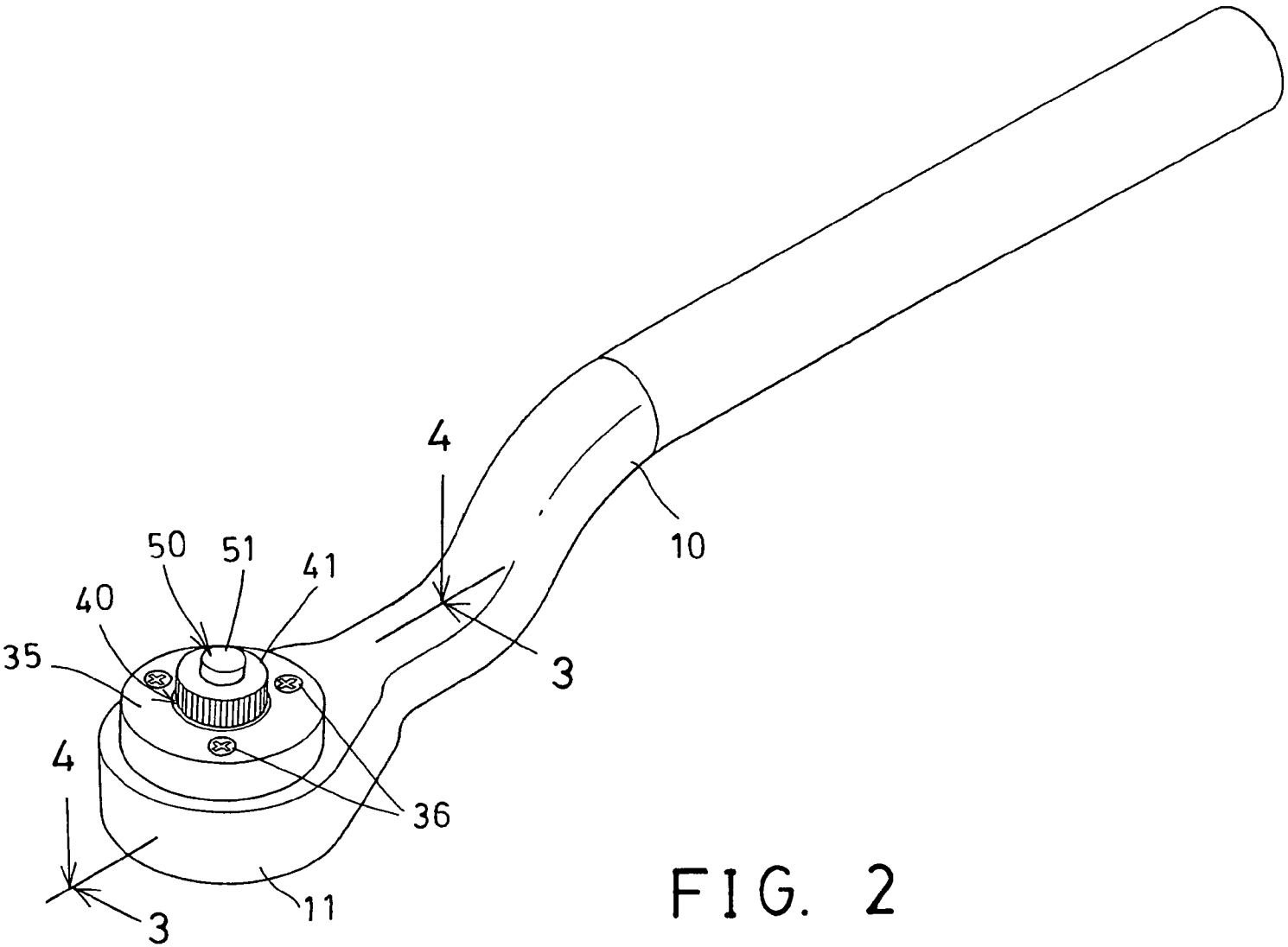
FIG. 2 is a perspective view of the ratchet tool.
Figure 3:
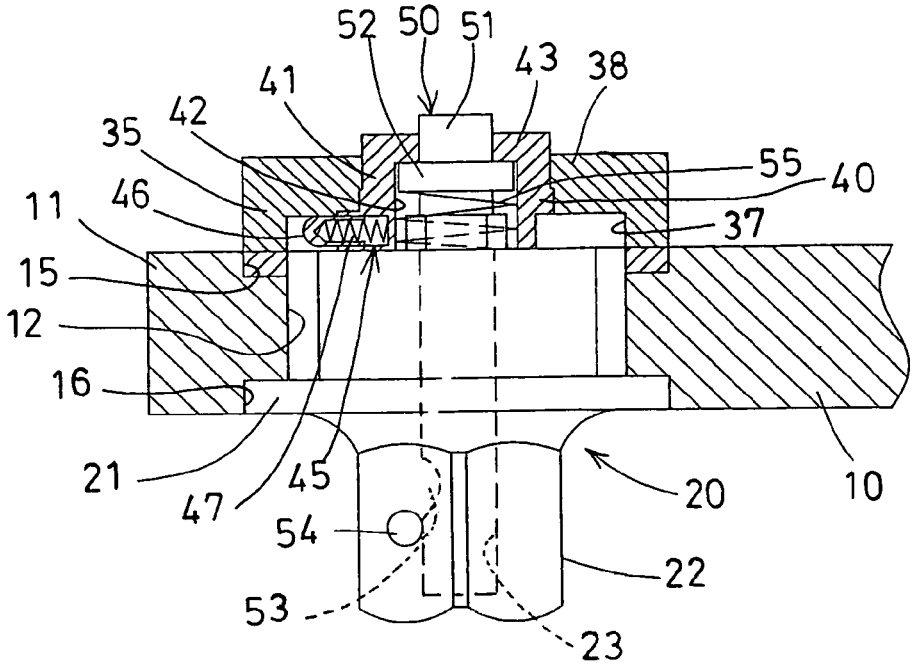
FIG. 3 is a partial cross sectional view of the ratchet tool, taken along lines 3—3 of FIG. 2.

Referring to the drawings, and initially to FIGS. 1–4, a ratchet tool in accordance with the present invention comprises a handle 10 including a head 11 formed or provided in one end thereof, and having a compartment 12 formed therein and defined by an inner peripheral surface 13, for rotatably receiving a cartridge 20 therein. The head 11 or the handle 10 includes a number of teeth 14 formed or provided on the inner peripheral surface 13 thereof, and includes two peripheral shoulders 15, 16 formed in the upper and the lower portions thereof, and preferably provided around the compartment 12 thereof.

The cartridge 20 is rotatably received in the compartment 12 of the head 11 or of the handle 10, and includes a peripheral panel 21 laterally or radially extended therefrom, for rotatably engaging in the bottom peripheral shoulder 16 of the head 11 or of the handle 10 (FIG. 3), and for stably and rotatably attaching the cartridge 20 to the head 11 or to the handle 10. The cartridge 20 includes a driving shank 22 extended downwardly therefrom, and extended out the head 11 or the handle 10, for engaging with and for driving such as fasteners, tool extensions, sockets, tool bits, or other tool members (not shown).

The cartridge 20 includes a bore 23 formed therein, and also formed in the driving shank 22, for slidably receiving a stem 50 therein, and includes an orifice 24 laterally formed in the driving shank 22 thereof (FIG. 1), and communicating with the bore 23 thereof. The cartridge 20 further includes three or more flat side surfaces 25 formed in the outer peripheral portion thereof, best shown in FIG. 5, to form or define an equiangular triangle, and to form or define three or more corner areas each having a protrusion 26 extended or provided thereon, and the three side surfaces 25 each includes a rounded cavity 27 formed in each of the flat surfaces 25 thereof and having a shape or cross section greater than one half but less then three quarters of a circle.

Figure 4:
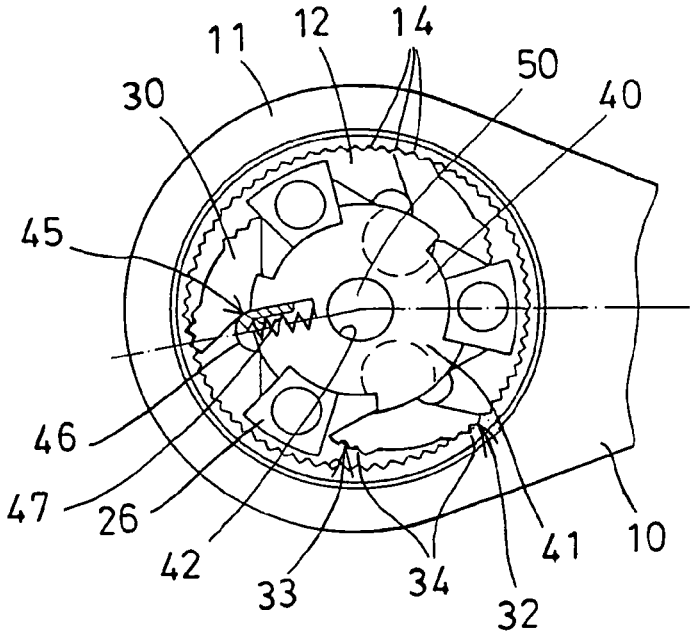
FIG. 4 is a partial cross sectional view of the ratchet tool, taken along lines 4—4 of FIG. 2.
Figure 5:
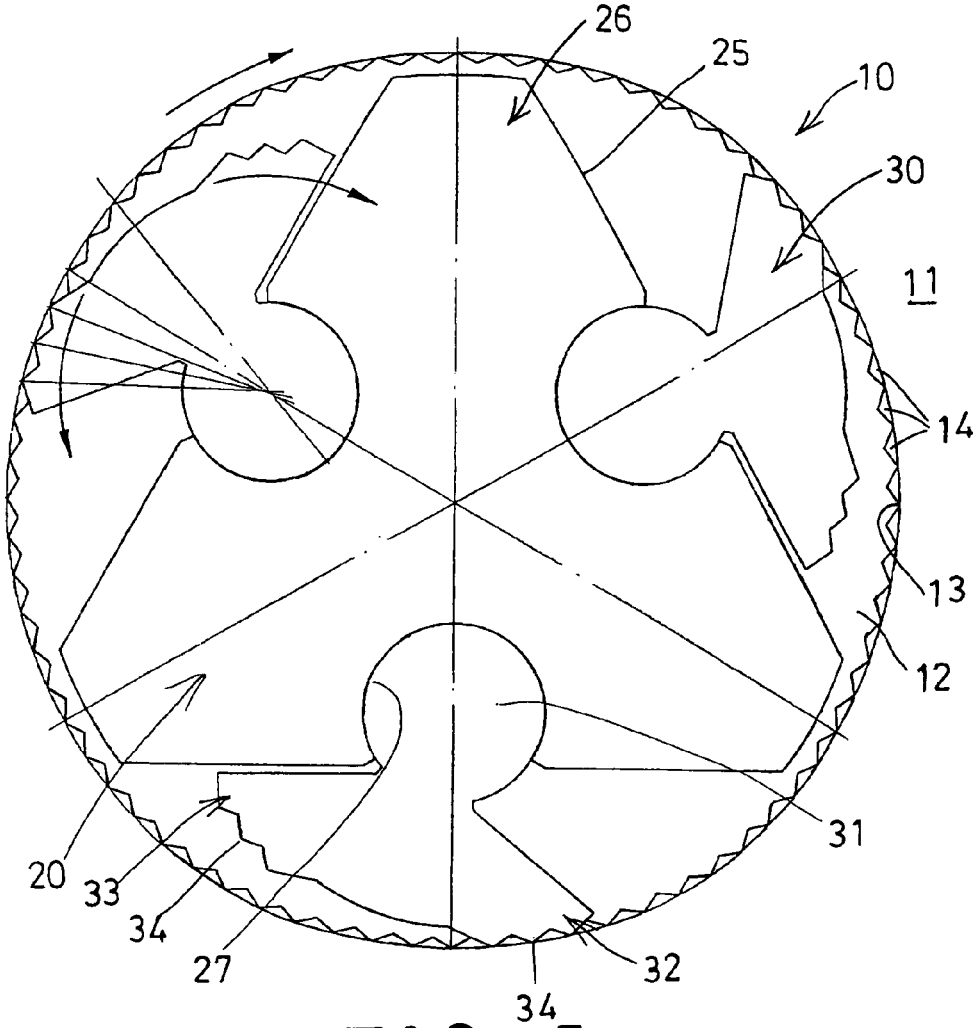
FIG. 5 is an enlarged partial cross sectional view of the ratchet tool.
Figure 6:
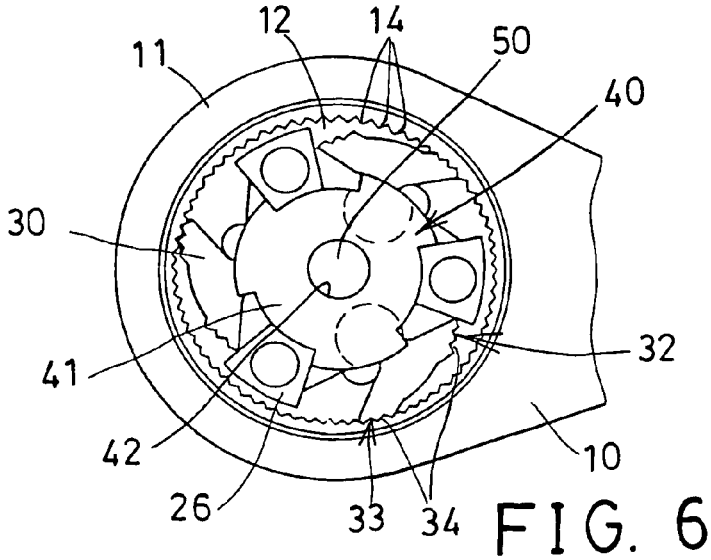
FIG. 6 is a partial cross sectional view similar to FIG. 4, illustrating the operation of the ratchet tool.

Three or more pawls 30 each includes a rounded shaft 31 extended therefrom, and rotatably engaged in the rounded cavities 27 of the cartridge 20 respectively, for rotatably attaching or securing the pawls 30 to the cartridge 20, The pawls 30 each further includes two end portions 32, 33 each having one or more teeth 34 formed and provided thereon, for engaging with the teeth 14 of the head 11 or of the handle 10, best shown in FIGS. 4–6, in order to control and to determine the driving directions of the cartridge 20 relative to the head 11 or the handle 10 or the driving directions of the ratchet tool.

A retaining ring 28 may further be provided and engaged with the protrusions 26 of the cartridge 20, for example, and rotatably engaged in the upper peripheral shoulder 15 of the head 11 or of the handle 10 (FIG. 3), for stably and rotatably attaching and securing the cartridge 20 to the head 11 or to the handle 10, and for allowing the teeth 34 of the pawls 30 to effectively engage with the teeth 14 of the head 11 or of the handle 10. A cover 35 may further be provided and secured onto the protrusions 26 of the cartridge 20 with such as fasteners 36, and includes a chamber 37 formed therein, and a peripheral flange 38 radially extended into the chamber 37 thereof.

A control member 40 is rotatably received in the chamber 37 of the cover 35, and rotatably secured or retained between the cartridge 20 and the peripheral flange 38 of the cover 35, or rotatably disposed relative to the cartridge 20, and includes a knob 41 extended upwardly therefrom, and rotatably engaged out through the chamber 37 and the peripheral flange 38 of the cover 35, for being rotated by the users. The control member 40 includes an orifice 42 formed therein for slidably receiving the stem 50 therein, and includes a peripheral rib 43 radially extended into the orifice 42 thereof, for engaging with and for limiting the stem 50 to slide relative to the control member 40 and the cartridge 20.

For example, the stem 50 includes an upper portion or button 51 extended upwardly and outwardly through the orifice 42 and the peripheral rib 43 of the control member 40, and includes a peripheral bulge 52 laterally or radially extended therefrom, for rotatably engaging with the peripheral rib 43 of the control member 40 (FIG. 3), and for stably and rotatably attaching the stem 50 to the control member 40, and thus for limiting the stem 50 to slide relative to the control member 40 and the cartridge 20, and for preventing the stem 50 from being disengaged from the control member 40 and the cartridge 20.

The stem 50 includes a recess 53 formed in the lower portion thereof, for receiving a ball 54 therein (FIG. 3), in which the ball 54 is also slidably received in the orifice 24 of the driving shank 22 of the cartridge 20 and engageable into the bore 23 of the driving shank 22 or of the cartridge 20. A spring member 55 may be engaged between the cartridge 20 and the peripheral bulge 52 or the stem 50, for biasing the button 51 of the stem 50 out through the orifice 42 and the peripheral rib 43 of the control member 40, and for disengaging the recess 53 of the stem 50 from the ball 54, and thus for allowing the stem 50 to urge and to force the ball 54 out of the orifice 24 of the driving shank 22.

For example, the ball 54 may be forced out of the orifice 24 of the driving shank 22 to detachably engage with the fasteners, the tool extensions, the sockets, the tool bits, or other tool members (not shown), and thus to detachably retain the fasteners or other tool members to the driving shank 22. The ball 54 may also be received within the orifice 24 of the driving shank 22 and received within the recess 53 of the stem 50 when the stem 50 is depressed downwardly relative to the control member 40 and the cartridge 20 against the spring member 55, to allow the fasteners or other tool members to be released from the driving shank 22.

The control member 40 further includes three or more apertures 44 formed in the outer peripheral portion thereof, and preferably equally spaced away from each other, and arranged corresponding to the pawls 30, and each for slidably receiving a spring-biased projection 45 therein. For example, each of the spring-biased projections 45 includes a detent 46 and a spring member 47 engaged with the detent 46, for biasing and forcing the detent 46 out of the apertures 44 of the control member 40, and for engaging with the pawls 30 respectively, in order to control and to force the teeth 34 of either of the end portions 32, 33 of the pawls 30 to engage with the teeth 14 of the head 11 or of the handle 10 (FIGS. 4, 6), and thus to control the driving directions of the cartridge 20 relative to the head 11 or the handle 10.

In operation, as shown in FIGS. 4–6, the three or more pawls 30 may each include one or more teeth 34 of either of the end portions 32, 33 of the pawls 30 to engage with the teeth 14 of the head 11 or of the handle 10, such that the teeth 34 of the end portions 32, 33 of the three or more pawls 30 may be forced or biased to evenly and stably engage with the teeth 14 of the head 11 or of the handle 10, and such that the driving torque between the cartridge 20 and the head 11 or the handle 10 may be greatly increased.

Figure 7:
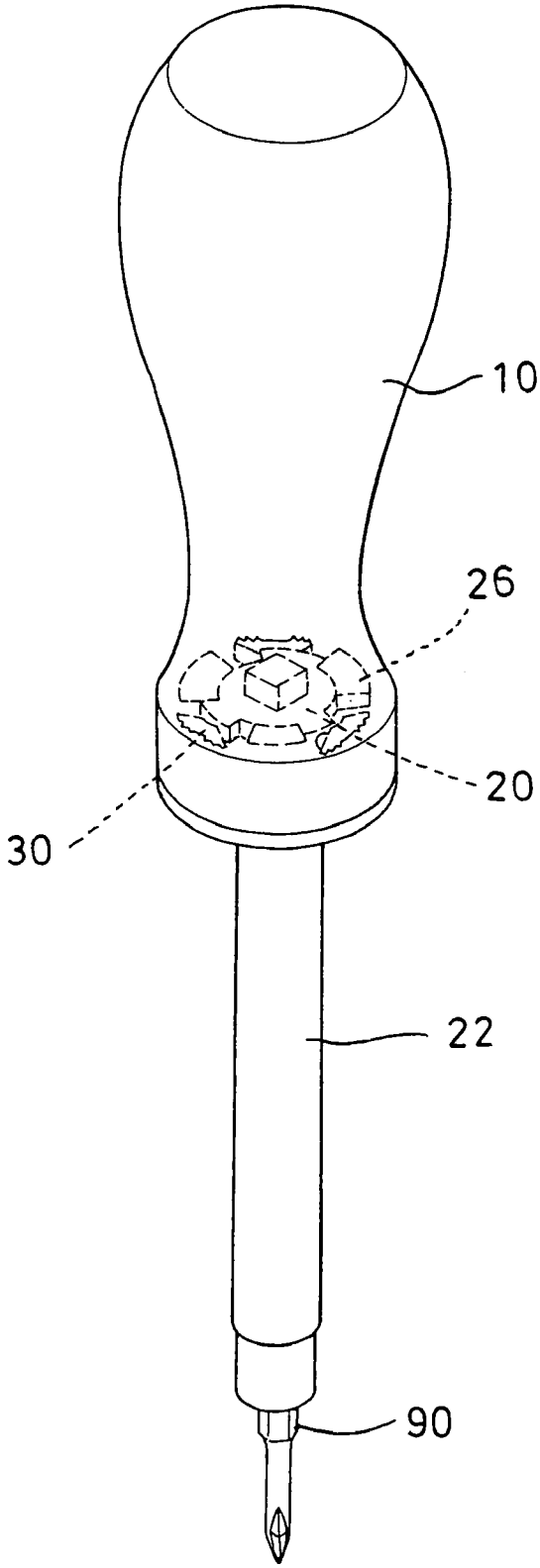
FIG. 7 is a perspective view of a ratchet tool illustrating another arrangement of the ratchet tool.

Alternatively, as shown in FIG. 7, the cartridge 20 and the pawls 30 may also be directly engaged or received within the handle 10, and the driving shank 22 of the cartridge 20 may be used to engage with a tool bit 90 of a screw driving tool device, such that the ratchet tool in accordance with the present invention may be provided and disposed in wrenches as shown in FIGS. 1–6, or in screw drivers as shown in FIG. 7.

Accordingly, the ratchet tool in accordance with the present invention includes an improved structure having an increased driving torque.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ratchet tool comprising:

a handle including a compartment formed therein and defined by an inner peripheral surface, and including a plurality of teeth provided on said inner peripheral surface thereof, a cartridge rotatably received in said compartment of said handle, and including a driving shank extended out of said handle, for engaging with fasteners or tool members, said cartridge including three side surfaces, three pawls rotatably attached to said side surfaces of said cartridge respectively, and each including two end portions each having at least one tooth provided thereon, for selectively engaging with said teeth of said handle, in order to control and to determine a driving direction of said cartridge relative to said handle, a control member rotatably disposed relative to said cartridge, and including three spring-biased projections disposed therein, for engaging with said pawls respectively, in order to control and to force said at least one tooth of either of said end portions of said pawls to engage with said teeth of said handle, and to control the driving direction of said cartridge relative to said handle, said at least one tooth of said three pawls being stably engaged with said teeth of said handle, to have an increased driving torque between said cartridge and said handle, and a cover secured to said cartridge, for stably and rotatably attaching said cartridge to said handle, said cover including a chamber formed therein for rotatably receiving said control member therein, and including a peripheral flange radially extended into said chamber thereof, for engaging with and for limiting said control member relative to said cover, and for preventing said control member from being disengaged from said cover and said cartridge, said control member including a knob extended therefrom, and rotatable engaged out through said chamber and said peripheral flange of said cover, for being rotated by users.

2. The ratchet tool as claimed in claim 1, wherein said cartridge includes a peripheral panel radially extended therefrom, for rotatably engaging with said handle, and for stably and rotatably attaching said cartridge to said handle.

3. The ratchet tool as claimed in claim 2, wherein said handle includes a peripheral shoulder formed therein, and provided around said compartment thereof, for rotatably receiving said peripheral panel of said cartridge.

4. The ratchet tool as claimed in claim 1, wherein said cartridge includes a cavity formed in each of said three side surfaces thereof, and said pawls each includes a shaft extended therefrom, and rotatably engaged in said cavities of said cartridge respectively, to rotatably attach and secure said pawls to said side surfaces of said cartridge respectively.

5. The ratchet tool as claimed in claim 1, wherein said control member includes three apertures formed therein, and equally spaced away from each other, and arranged corresponding to said pawls respectively, to slidably receive said spring-biased projections respectively.

6. The ratchet tool as claimed in claim 1, wherein said cartridge includes a retaining ring attached thereto, for rotatably engaging with said handle, and for stably and rotatably attaching said cartridge to said handle.

7. The ratchet tool as claimed in claim 6, wherein said handle includes a peripheral shoulder formed therein, and provided around said compartment thereof, for rotatably receiving said retaining ring.

8. A ratchet tool comprising:

a handle including a compartment formed therein and defined by an inner peripheral surface, and including a plurality of teeth provided on said inner peripheral surface thereof, a cartridge rotatable received in said compartment of said handle, and including a driving shank extended out of said handle, for engaging with fasteners or tool members, said cartridge including three side surfaces, said cartridge including a cavity formed in each of said three side surfaces thereof, and said cavities of said cartridge each including a cross section greater than one half but less then three quarters of a circles three pawls each including a shaft rotatably engaged in said cavities of said cartridge for rotatable attaching said pawls to said side surfaces of said cartridge respectively, and each including two end portions each having at least one tooth provided thereon, for selectively engaging with said teeth of said handle, in order to control and to determine a driving direction of said cartridge relative to said handle, and a control member rotatable disposed relative to said cartridge, and including three spring-biased projections disposed therein, for engaging with said pawls respectively, in order to control and to force said at least one tooth of either of said end portions of said pawls to engage with said teeth of said handle, and to control the driving direction of said cartridge relative to said handle, said at least one tooth of said three pawls being stably engaged with said teeth of said handle, to have an increased driving torque between said cartridge and said handle.

9. A ratchet tool comprising:

a handle including a compartment formed therein and defined by an inner peripheral surface, and including a plurality of teeth provided on said inner peripheral surface thereof, a cartridge rotatably received in said compartment of said handle, and including a driving shank extended out of said handle, for engaging with fasteners or tool members, said cartridge including three side surfaces, three pawls rotatably attached to said side surfaces of said cartridge respectively, and each including two end portions each having at least one tooth provided thereon, for selectively engaging with said teeth of said handle, in order to control and to determine a driving direction of said cartridge relative to said handle, and a control member rotatably disposed relative to said cartridge, and including three spring-biased projections disposed therein, for engaging with said pawls respectively, in order to control and to force said at least one tooth of either of said end portions of said pawls to engage with said teeth of said handle, and to control the driving direction of said cartridge relative to said handle, said at least one tooth of said three pawls being stably engaged with said teeth of said handle, to have an increased driving torque between said cartridge and said handle, said control member including an orifice formed therein, and said cartridge including a bore formed therein and also formed in said driving shank and including an orifice laterally formed in said driving shank and communicating with said bore thereof, a ball received in said orifice of said driving shank and engageable into said bore of said cartridge, and a stem slidably received in said bore of said cartridge and having a recess formed therein for receiving said ball therein, and a biasing means for biasing said stem relative to said cartridge, to disengage said recess of said stem from said ball, and to force said stem to force said ball out of said driving shank, and said ball being receivable in said recess of said stem when said recess of said stem is aligned with said ball, and when said stem is depressed against said biasing means.

10. The ratchet tool as claimed in claim 9, wherein said control member includes a peripheral rib radially extended into said orifice thereof, and said stem includes a peripheral bulge radially extended therefrom, for rotatably engaging with said peripheral rib of said control member, and for stably and rotatably attaching said stem to said control member, and for limiting said stem to slide relative to said control member and said cartridge, and for preventing said stem from being disengaged from said control member and said cartridge.

* * * * *